US008128070B1

(12) United States Patent
Allan et al.

(10) Patent No.: US 8,128,070 B1
(45) Date of Patent: Mar. 6, 2012

(54) VENTURI AERATION CIRCULATION SYSTEM

(76) Inventors: John M. Allan, Seminole, FL (US); Nicholas J. Reale, Seminole, FL (US)

( * ) Notice: Subject to any disclaimer, the term of this patent is extended or adjusted under 35 U.S.C. 154(b) by 686 days.

(21) Appl. No.: 12/287,968

(22) Filed: Oct. 14, 2008

Related U.S. Application Data

(60) Provisional application No. 61/038,788, filed on Mar. 24, 2008.

(51) Int. Cl.
*B01F 3/04* (2006.01)

(52) U.S. Cl. ..... 261/36.1; 261/76; 261/122.1

(58) Field of Classification Search ..... 261/36.1, 261/76, 77, 122.1, 124, DIG. 70, DIG. 75
See application file for complete search history.

(56) References Cited

U.S. PATENT DOCUMENTS 3,295,326 A * 1/1967 White ..... 405/61
4,522,151 A * 6/1985 Arbisi et al. ..... 261/76
4,639,340 A * 1/1987 Garrett ..... 261/36.1
4,640,782 A * 2/1987 Burleson ..... 210/748.19
4,857,350 A * 8/1989 Iwasaki et al. ..... 426/506
5,087,292 A * 2/1992 Garrido ..... 75/681
5,403,522 A * 4/1995 Von Berg ..... 261/36.1
5,514,267 A * 5/1996 Machiya et al. ..... 210/170.06
5,520,856 A * 5/1996 Garrett et al. ..... 261/76
5,741,443 A * 4/1998 Gemza ..... 261/77
6,241,897 B1 * 6/2001 Hanson et al. ..... 210/739
6,398,194 B1 * 6/2002 Tsai et al. ..... 261/36.1

* cited by examiner

*Primary Examiner* — Charles Bushey

(57) ABSTRACT

An intake pipe is positionable adjacent to the bottom of a body of water. The intake pipe has at least one perforate section adapted to receive stagnating un-aerated water. A discharge pipe is positionable between a waterline of the body of water and the discharge pipe. The discharge pipe has at least one orifice for injecting aerated water into the body of water. An intermediate pipe section has an input end coupled to the discharge pipe. The intermediate pipe section has an output end coupled to the discharge pipe. A pump moves water from the perforate section of the intake pipe to the orifice of the discharge pipe. A venturi assembly injects air into water flowing to and through and out of the discharge pipe into the body of water.

5 Claims, 4 Drawing Sheets

FIG 1
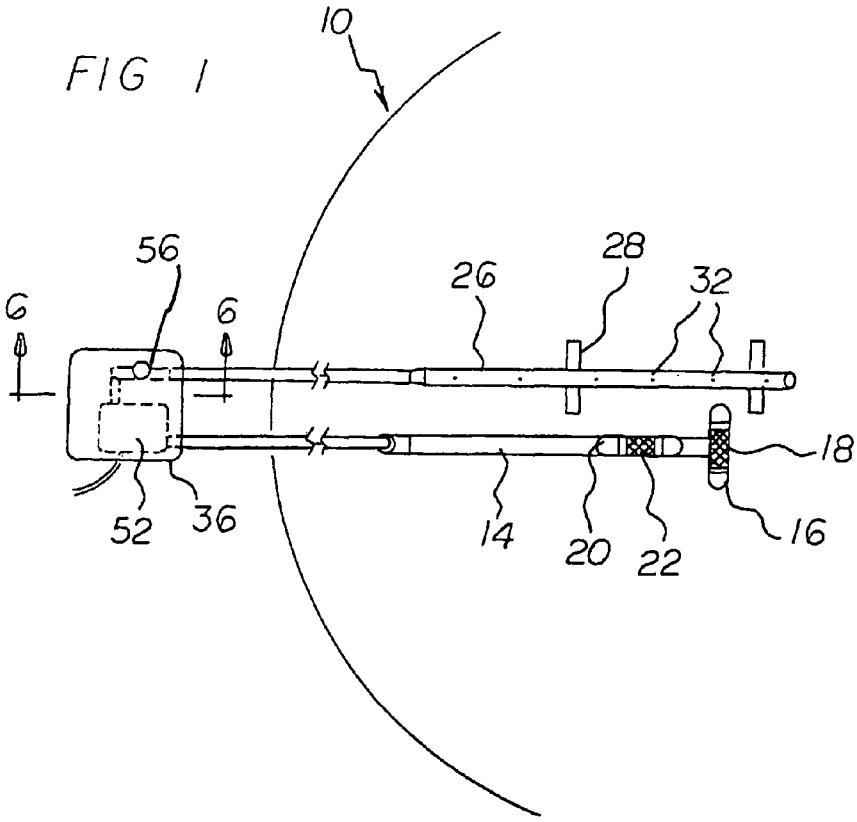
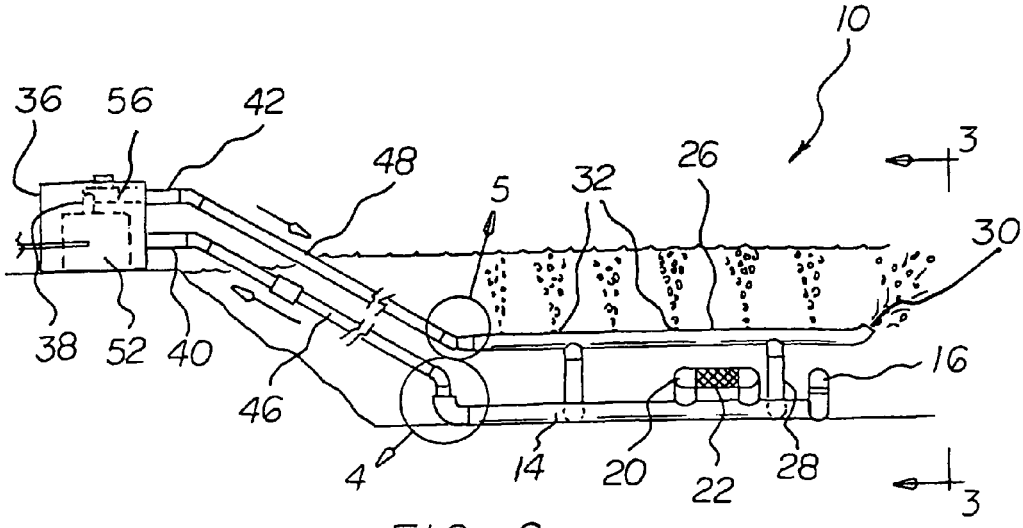
FIG 2

FIG 3
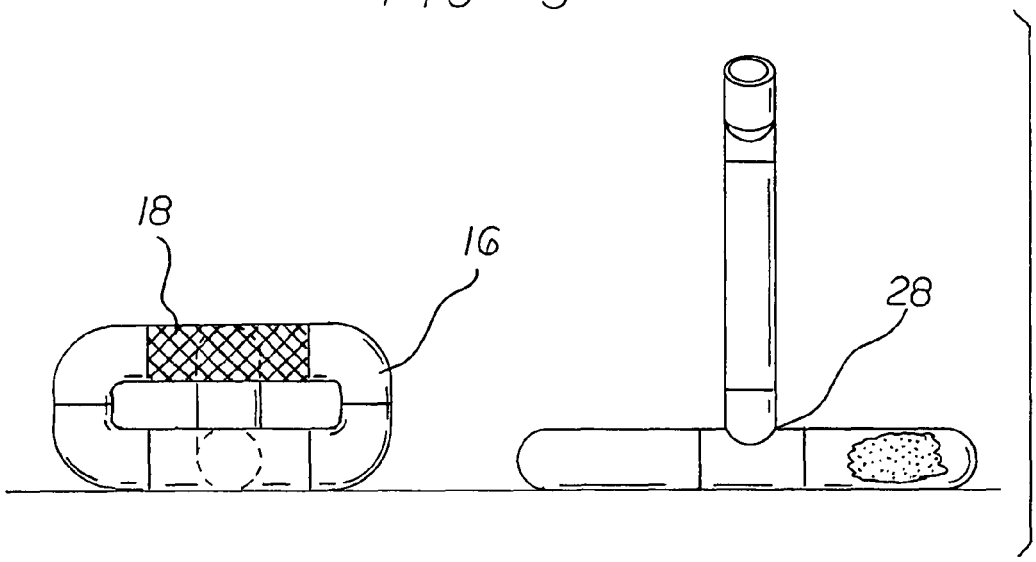
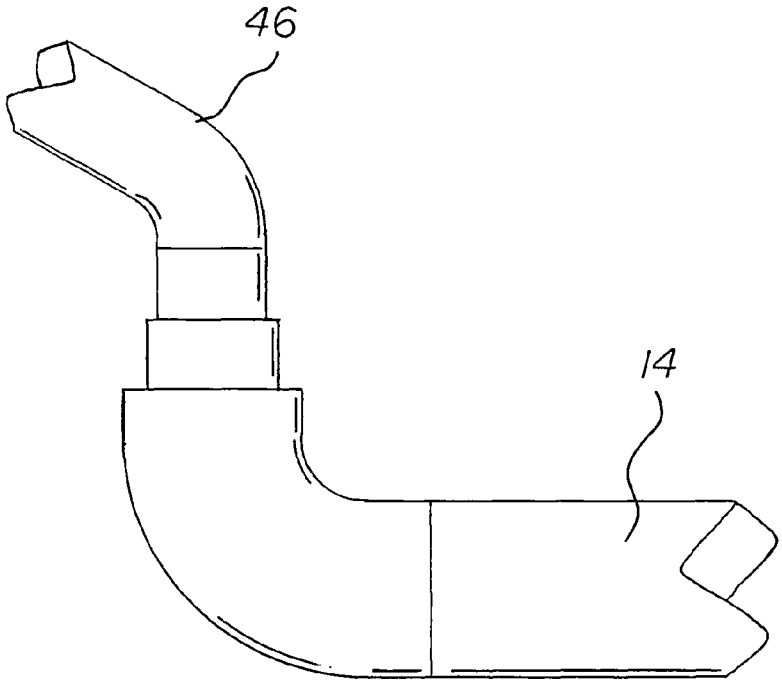
FIG 4

FIG 5
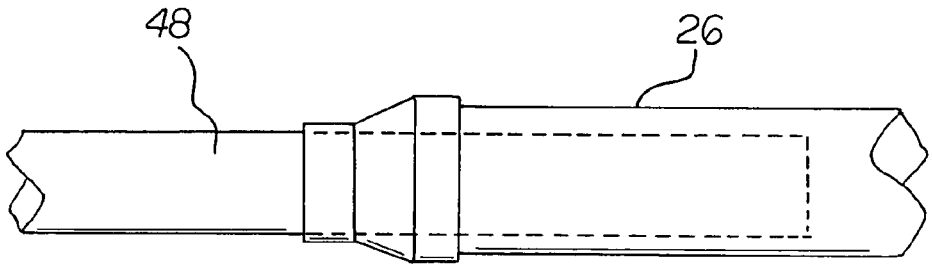
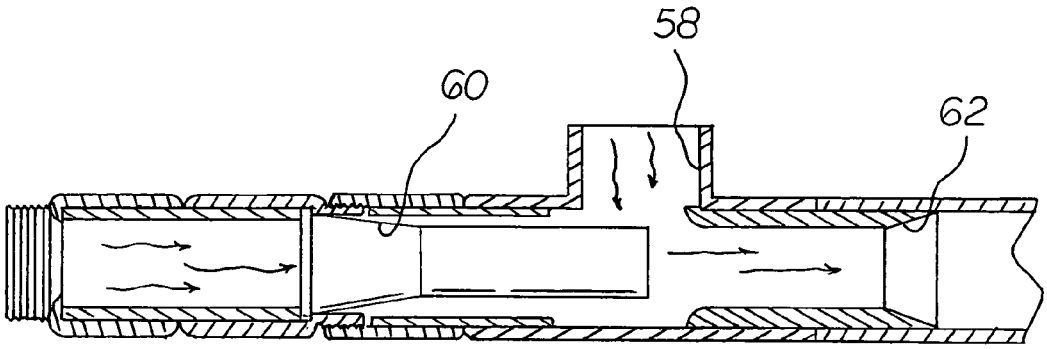
FIG 6

FIG 7
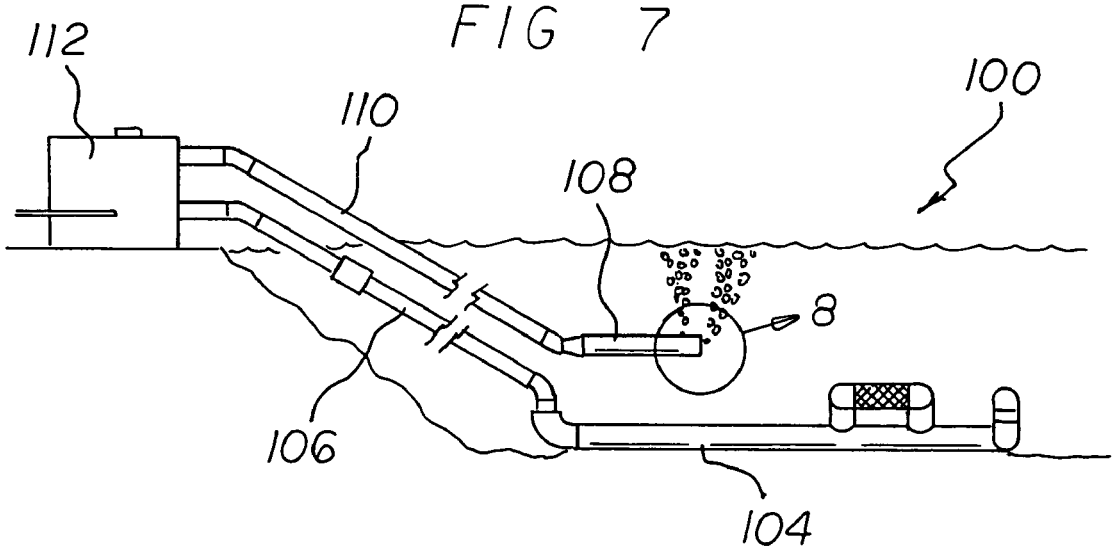
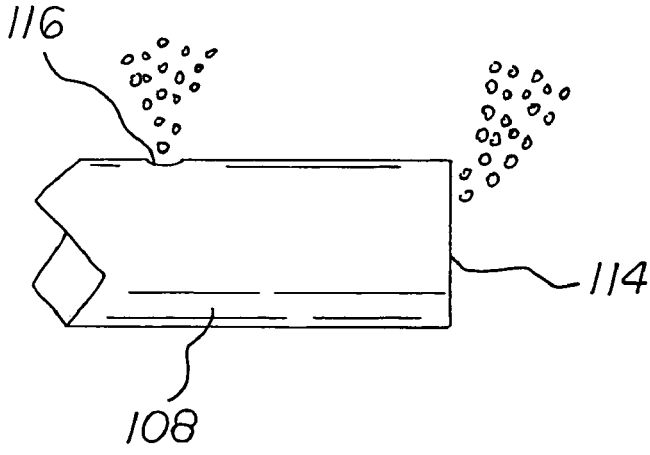
FIG 8

VENTURI AERATION CIRCULATION SYSTEM

RELATED APPLICATION

This present Non-Provisional U.S. patent application is based upon pending Provisional Application No. 61/038,788 filed Mar. 24, 2008, the subject matter of which is incorporated herein by reference.

TO ALL WHOM IT MAY CONCERN

BE IT KNOWN THAT WE, JOHN M. ALLAN, a citizen of SCOTLAND (United Kingdom) AND NICHOLAS. J. REALE, a citizen of the UNITED STATES OF AMERICA, have invented new and useful improvements in a VENTURI AERATION CIRCULATION SYSTEM of which the following is a specification:

BACKGROUND OF THE INVENTION

1. Field of the Invention

The present invention relates to a venturi aeration circulation system and more particularly pertains to aerating and circulating water in a body of water with a low interior venturi pressure in a safe, ecologically friendly, convenient and energy efficient manner.

2. Description of the Prior Art

In order to keep certain bodies of water in a healthy condition, circulation and aeration of the water body on a constant basis is important. Water bodies become stagnant and start to stratify with the sickest, least amount of dissolved oxygen, at the lowest levels with healthier water, oxygenated, toward the higher levels. These conditions lead to fish kills, algae blooms and other undesirable effects. Current systems offered are expensive to purchase, maintain and operate and are often out of reach financially to people living on or near these bodies of water. The goal was to produce a cost effective, limited maintenance, electrically efficient system that would accomplish the goal of circulation and aeration.

Currently available systems, such as diffusers and surface aerators, utilize high-energy usage pumps, usually greater than 6 amps. It usually takes multiple systems running 24/7/365 to produce results and the effects are negligible in shallow water bodies, less than 6 feet deep. These systems also require costly yearly maintenance to rebuild portions of the pumps and diffuser stone maintenance.

The use of circulation systems of known designs and configurations is known in the prior art. More specifically, circulation systems of known designs and configurations previously devised and utilized for the purpose of circulating water through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,954,615 issued May 4, 1976 to Sheief relates to Apparatus for Sewage Treatment and Wastewater Reclamation. Further, U.S. Pat. No. 7,361,268 issued Apr. 22, 2008 to Ogden relates to Waste Treatment Systems.

While these devices fulfill their respective, particular objectives and requirements, the aforementioned patents do not describe a venturi aeration circulation system that allows for aerating and circulating water in a pond with a low interior venturi pressure in a safe, ecologically friendly, convenient and energy efficient manner.

In this respect, the venturi aeration circulation system according to the present invention substantially departs from the conventional concepts and designs of the prior art, and in doing so provides an apparatus primarily developed for the purpose of aerating and circulating water in a pond with a low interior venturi pressure in a safe, ecologically friendly, convenient and energy efficient manner.

Therefore, it can be appreciated that there exists a continuing need for a new and improved venturi aeration circulation system which can be used for aerating and circulating water in a pond with a low interior venturi pressure in a safe, ecologically friendly, convenient and energy efficient manner. In this regard, the present invention substantially fulfills this need.

SUMMARY OF THE INVENTION

In view of the foregoing disadvantages inherent in the known types of circulation systems of known designs and configurations now present in the prior art, the present invention provides an improved venturi aeration circulation system. As such, the general purpose of the present invention, which will be described subsequently in greater detail, is to provide a new and improved venturi aeration circulation system and method which has all the advantages of the prior art and none of the disadvantages.

To attain this, the present invention essentially comprises a venturi aeration circulation system. First provided is an intake pipe. The intake pipe is positioned essentially horizontally beneath a waterline of a pond adjacent to the bottom the pond. The intake pipe has an interior section. The intake pipe has an exterior section. The exterior section has an exterior rectangle. The exterior rectangle extends upwardly transverse to the intake pipe. The exterior rectangle has a circumferential first perforate section. The intake pipe has an intermediate section. The intermediate section has an upwardly extending rectangle. The upwardly extending rectangle extends upwardly parallel with the intake pipe. The intermediate rectangle has a circumferential second perforate section. The perforate sections are adapted to receive stagnating un-aerated water from a lower extent of the pond during operation and use.

A discharge pipe is provided. The discharge pipe is positioned essentially horizontally and about midway between a waterline of a pond and the discharge pipe. The discharge pipe is positioned above and laterally offset from the intake pipe. The discharge pipe has legs. The legs support the discharge pipe. The discharge pipe has an interior section. The discharge pipe has an exterior section. The exterior section has an exterior orifice. The discharge pipe has an intermediate section. The intermediate section has a plurality of upwardly facing axially spaced orifices. In this manner aerated water is injected into an upper extent of a pond during operation and use. The discharge pipe has an axial length greater than the intake pipe.

Provided next is a housing. The housing is in a rectilinear configuration. The housing is positioned above ground adjacent to the pond. The housing has a top. The housing has a bottom. The housing has a front. The housing also has a back. The housing has first and second sides. An L-shaped pipe section is provided. The L-shaped pipe section is provided within the housing. The L-shaped pipe has an input end. The input end is provided adjacent to the first side and bottom of the housing. The L-shaped pipe has an output end. The output end is provided adjacent to the second side and top of the housing.

A lower angled pipe is provided. The lower angled pipe couples the output end of the intake pipe to the input end of the L-shaped pipe. The intersection of the intake pipe and the lower angled pipe are in a generally S-shaped configuration. The intake pipe has a greater diameter than the lower angled pipe. An upper angled pipe is provided. The upper angled pipe couples the input end of the discharge pipe to the output end of the L-shaped pipe. The intersection of the discharge pipe and the upper angled pipe feature the intake pipe extending into, and having a lesser diameter than, the lower angled pipe.

Further provided is a pump. The pump is provided in the housing. The pump is operatively associated with the L-shaped pipe. The pump is provided adjacent to the input end of the L-shaped pipe. In this manner water is moved from the perforate sections of the intake pipe to the orifices of the discharge pipe.

Provided last is a venturi assembly. The venturi assembly is provided in the L-shaped pipe. The venturi assembly is provided adjacent to the output end of the L-shaped pipe. In this manner air is injected into water flowing to and through and out of the discharge pipe into the pond. The venturi assembly includes a tubularly shaped, upwardly extending, air opening. The venturi assembly includes a primary nozzle. The primary nozzle is provided upstream of the air opening. In this manner the interior diameter of the L-shaped pipe at the air opening is reduced. The venturi assembly includes a secondary nozzle. The secondary nozzle is provided downstream of the air opening. In this manner the interior diameter of the L-shaped pipe is decreased at the air opening. Further in this manner pond water is circulated when the pump is operating. The circulating water is aerated through the operation of the venturi assembly.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved venturi aeration circulation system which has all of the advantages of the prior art circulation systems of known designs and configurations and none of the disadvantages.

It is another object of the present invention to provide a new and improved venturi aeration circulation system which may be easily and efficiently manufactured and marketed.

It is further object of the present invention to provide a new and improved venturi aeration circulation system which is of durable and reliable constructions.

An even further object of the present invention is to provide a new and improved venturi aeration circulation system which is susceptible of a low cost of manufacture with regard to both materials and labor, and which accordingly is then susceptible of low prices of sale to the consuming public, thereby making such venturi aeration circulation system economically available to the buying public.

Even still another object of the present invention is to provide a venturi aeration circulation system for aerating and circulating water in a pond with a low interior venture pressure in a safe, ecologically friendly, convenient and energy efficient manner.

Lastly, it is an object of the present invention to provide a new and improved venturi aeration circulation system. An intake pipe is positionable adjacent to the bottom of a body of water. The intake pipe has at least one perforate section adapted to receive stagnating un-aerated water. A discharge pipe is positionable between a waterline of the body of water and the discharge pipe. The discharge pipe has at least one orifice for injecting aerated water into the body of water. An intermediate pipe section has an input end coupled to the discharge pipe. The intermediate pipe section has an output end coupled to the discharge pipe. A pump moves water from the perforate section of the intake pipe to the orifice of the discharge pipe. A venturi assembly injects air into water flowing to and through and out of the discharge pipe into the body of water.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 a plan view of a venturi aeration circulation system constructed in accordance with the principles of the present invention.

FIG. 2 is a side elevational view of the system shown in FIG. 1.

FIG. 3 is an end elevational view of the system taken along line 3-3 of FIG. 2.

FIGS. 4 and 5 are enlarged showings taken at Circles 4 and 5 of FIG. 2.

FIG. 6 is a cross sectional view taken along line 6-6 of FIG. 1.

FIG. 7 is a side elevational view of an alternate embodiment of the invention.

FIG. 8 is enlarged showing of the end of the discharge tube taken at Circle 8 of FIG. 7.

The same reference numerals refer to the same parts throughout the various Figures for the various embodiments of the invention.

DESCRIPTION OF THE PREFERRED EMBODIMENT

With reference now to the drawings, and in particular to FIG. 1 thereof, the preferred embodiment of the new and improved venturi aeration circulation system embodying the principles and concepts of the present invention and generally designated by the reference numeral 10 will be described.

The present invention, the venturi aeration circulation system 10 is comprised of a plurality of components. Such components in their broadest context include an intake pipe, a discharge pipe, an intermediate pipe section, a pump and a venturi assembly. Such components are individually configured and correlated with respect to each other so as to attain the desired objective.

First provided is an intake pipe 14. The intake pipe is positioned essentially horizontally beneath a waterline of a pond adjacent to the bottom the pond. The intake pipe has an interior section. The intake pipe has an exterior section. The exterior section has an exterior rectangle 16. The exterior rectangle extends upwardly transverse to the intake pipe. The exterior rectangle has a circumferential first perforate section 18. The intake pipe has an intermediate section. The intermediate section has an upwardly extending rectangle 20. The upwardly extending rectangle extends upwardly parallel with the intake pipe. The intermediate rectangle has a circumferential second perforate section 22. The perforate sections are adapted to receive stagnating un-aerated water from a lower extent of the pond during operation and use.

A discharge pipe 26 is provided. The discharge pipe is positioned essentially horizontally and about midway between a waterline of a pond and the discharge pipe. The discharge pipe is positioned above and laterally offset from the intake pipe. The discharge pipe has legs 28. The legs support the discharge pipe. The discharge pipe has an interior section. The discharge pipe has an exterior section. The exterior section has an exterior orifice 30. The discharge pipe has an intermediate section. The intermediate section has a plurality of upwardly facing axially spaced orifices 32. In this manner aerated water is injected into an upper extent of a pond during operation and use. The discharge pipe has an axial length greater than the intake pipe.

Provided next is a housing 36. The housing is in a rectilinear configuration. The housing is positioned above ground adjacent to the pond. The housing has a top. The housing has a bottom. The housing has a front. The housing also has a back. The housing has first and second sides. An L-shaped pipe section 38 is provided. The L-shaped pipe section is provided within the housing. The L-shaped pipe has an input end 40. The input end is provided adjacent to the first side and bottom of the housing. The L-shaped pipe has an output end 42. The output end is provided adjacent to the second side and top of the housing.

A lower angled pipe 46 is provided. The lower angled pipe couples the output end of the intake pipe to the input end of the L-shaped pipe. The intersection of the intake pipe and the lower angled pipe are in a generally S-shaped configuration. The intake pipe has a greater diameter than the lower angled pipe. An upper angled pipe 48 is provided. The upper angled pipe couples the input end of the discharge pipe to the output end of the L-shaped pipe. The intersection of the discharge pipe and the upper angled pipe feature the intake pipe extending into, and having a lesser diameter than, the lower angled pipe.

Further provided is a pump 52. The pump is provided in the housing. The pump is operatively associated with the L-shaped pipe. The pump is provided adjacent to the input end of the L-shaped pipe. In this manner water is moved from the perforate sections of the intake pipe to the orifices of the discharge pipe.

Provided last is a venturi assembly 56. The venturi assembly is provided in the L-shaped pipe. The venturi assembly is provided adjacent to the output end of the L-shaped pipe. In this manner air is injected into water flowing to and through and out of the discharge pipe into the pond. The venturi assembly includes a tubularly shaped, upwardly extending, air opening 58. The venturi assembly includes a primary nozzle 60. The primary nozzle is provided upstream of the air opening. In this manner the interior diameter of the L-shaped pipe at the air opening is reduced. The venturi assembly includes a secondary nozzle 62. The secondary nozzle is provided downstream of the air opening. In this manner the interior diameter of the L-shaped pipe is decreased at the air opening. Further in this manner pond water is circulated when the pump is operating. The circulating water is aerated through the operation of the venturi assembly.

Reference is now made to the alternate embodiment 100 of the invention as illustrated in FIGS. 7 and 8. In such embodiment, the components are essentially the same as in the primary embodiment as described above. Included are an intake pipe 104, a lower angled pipe 106, a discharge pipe 108 and an upper angled pipe 110. A housing assembly supports an intermediate L-shaped pipe with a pump and a venturi assembly. Water is discharged through the end of the discharge pipe 114 and a single orifice 116. Unlike the primary embodiment, the discharge pipe is axially shorter than the intake pipe.

Measurable water circulation, aeration with a low cost electrical efficiency and minimal maintenance was the goal of the present invention.

This invention accomplishes aeration and circulation for approximately ⅓ the cost of other equipment in today's market while being low maintenance and energy efficient. This invention meets the demands of today's "Green Score" consciousness.

Aeration/circulation of water bodies with low electrical consumption is achieved by judicious use of a high electrical efficiency, low pressure/high volume water pump operating on less than 3.5 amps at 115 volts. Utilizing a venturi injector design that allows for 110 GPM water delivery with over 6 CFM of air mixture through at least 10 feet of pipe with air relief jets and a directional nozzle at the final discharge.

Circulation is achieved in several ways, decreasing the stratification and stagnation of the water body. First method of circulation occurs when the intake is placed near the bottom of the water body, thereby taking the least oxygenated and circulated water, aerating and discharging it higher in the water column creating a vertical mixture. The second method of circulation is the directional nozzle that discharges the water in an angled horizontal pattern in the water column creating push of water outward and upward. The third method of circulation is the air relief jets where the escaping air column pulls water upward and then breaks the surface tension allowing for more dissolved oxygen transfer and water movement.

Aeration is accomplished using a venturi design that allows for a high volume of air with very low water pressure. The pressure needed to operate the venturi is less than 2 PSI with air delivery at least 6 CFM. The water/air mixture is then turbulently pushed through at least 10 feet of pipe maximizing the water/air interaction creating high dissolved oxygen transfer. In shallower lakes this creates the effect of deeper water oxygen transfer.

The system of the present invention is made up of 4 components.

1. Electric Water Pump
2. Intake
3. Discharge
4. Venturi Injector

Electric Water Pump: Commercially available pump with the following specifications.

At least 2 inch intake and discharge fittings.

Can pump at least 110 GPM water

Is an out of water pump

Uses less than 3.5 amps at 115 volts

Is designed for continuous duty

Venturi Injector:

Commercially available materials with the following specifications.

PVC piping 2 inch diameter schedule 40

PVC piping 1.5 inch diameter schedule 40

PVC piping 1.25 inch diameter schedule 40

PVC Pipe Cleaner

PVC Pipe Glue

PVC 2 inch fittings schedule 40

Heat Process

Shaping Molds

The venturi is made up of three components:

Discharge/injector 1.25 inch PVC Pipe—modified

Air Chamber 2 inch PVC Tee

Receiver 1.5 inch PVC Pipe—modified

Air Chamber:

The air chamber consists of a standard 2 inch PVC schedule 40 Tee and a 2 inch threaded female adapter glued to tee. This accommodates the male thread of the injector assembly.

Assembled Injector:

The Discharge/Injector is then placed into a 2 inch threaded male adapter followed by a 2 inches×3 inch long pipe used to seat and align the injector. The assembly is completed using a second 2 inch threaded male adapter. The threaded adapters allow for adjustments to injector depth. All pipe and fittings are glued according to manufacturers guidelines.

Discharge/Injector:

This a stock piece of 1.25 inch PVC pipe modified by heating and shaping the pipe to achieve a conical shape from 2 inch ID to its original 1.25 inch ID. The resulting conical pipe is 6 3/inch long. The taper is 2 inch long total starting with an 2 inch ID to a 1.25 inch ID.

Receiver:

Receiver is a stock piece of 1.5 inch×3.25 inch PVC pipe modified by heating and shaping each end to achieve a conical taper. The larger end is done first shaping the pipe from is 1.5 inch ID to 2 inch ID in the first 1 inch. This is then inserted into a 2⅜ inch piece of stock 2 inch PVC pipe. The smaller end is then heated and shaped to 1⅞ inch ID over ¼ inch. This locks the receiver in place and allows for insertion into the air chamber.

The components are then glued together and attached to the pump with 2 inch threaded fittings. The intake and discharge are placed into the water body, primed and positioned for best effect.

Intake:

Commercially available materials with the following specifications.

PVC piping 4 inch diameter S & D pipe

PVC piping 2 inch diameter schedule 40

PVC Pipe Cleaner

PVC Pipe Glue

PVC 2 inch swing check valve

PVC 2 inch fittings schedule 40

PVC 4 inch fittings S & D pipe

The intake is designed based on the shape and size of the water body. Typical construction requires 30 feet of intake piping. The 2-inch pipe that enters the pump attaches to the listed check valve typically leaving the pump at a 45-degree angle and enters the water body. This is then attached to the larger diameter 4 inch pipe utilizing a reducer. All pipe and connections are cleaned and glued according to manufacture recommendations. This intake is then placed in the water body in the most advantageous position to promote circulation. Depending on the lake composition and possible blockages certain steps such as screening will be placed on the intake to protect the high rate of water flow being blocked by fish, weeds, turtles etc.

Discharge:

Commercially available materials with the following specifications.

PVC piping 4 inch diameter S & D pipe

PVC piping 3 inch diameter schedule 40

PVC piping 2 inch diameter schedule 40

PVC Pipe Cleaner

PVC Pipe Glue

PVC 2 inch fittings schedule 40

PVC 4 inch fittings S & D pipe

PVC 3 inch fittings schedule 40

120 lbs ballast (Sand or Gravel)

The discharge is sized based on the shape and size of the water body. Typical construction requires at least 10 feet of discharge pipe. The final height of the discharge nozzle is dependent on the water body depth. The height used is to optimize circulation and de-stratification.

Main Discharge Pipe Construction:

3 inch pipe is glued and fitted in a straight line with placement of two holders for the legs. In one embodiment, the last 20 feet of piping has 1/16 inch vertical holes drilled at 3 foot intervals. Each interval requires more holes as the pipe extends from the pump.

For Example:

With up to 6 groups of holes:

Grouping 1-2 holes

Grouping 2-3 holes

Grouping 3-4 holes

Grouping 4-5 holes

Grouping 5-6 holes

Grouping 6-7 holes

This allows for spaced airflow with vertical distribution of water.

A directional 3 inch solid bore nozzle is placed on the end of the pipe. The direction and position are to maximize water flow and circulation. This adjustment depends on the water body.

Pipe Stand Construction:

This consists of 2 sections of 4 inch S & D pipe 2½ feet long filled with 30 lbs of ballast each. A 4 inch S & D pipe tee is used to connect the feet with an upright of 3 inch schedule 40 pipe to anchor to main discharge pipe. 4 inch caps are glued to contain the ballast in the legs and stand assembly is glued to main discharge pipe. Air holes are drilled in the feet to allow excess air to escape.

Due to the volume of air through the discharge pipe typical construction requires at least 2 sets of stands for the main discharge pipe at approximately 10-foot intervals.

Venturi Injector to Main Discharge Pipe Construction:

2 inch pipe is glued and fitted utilizing proper adaptors making the connection to the Main Discharge Pipe through a modified adaptor. The 2 inch pipe enters the 3 inch pipe through the adaptor, protruding 6 inches into the Main Discharge Pipe. This is done to maximize turbidity and air mixture. It also reduces air backpressure into venturi injector, increasing overall performance.

The adapter is a 3 inch to 2 inch schedule 40 PVC reducer modified by removing existing pipe stop boss from reducer allowing 2-inch pipe to protrude past aforementioned stop by 6 inches, pipe is then glued in place.

The 3 inch to 2 inch modified reducer is then placed onto the 3 inch discharge pipe and glued in place.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A venturi aeration circulation system comprising:

an intake pipe positionable adjacent to the bottom of a body of water, the intake pipe having at least one perforate section adapted to receive stagnating un-aerated water;

a discharge pipe positionable between a waterline of the body of water and the intake pipe, the discharge pipe having at least one orifice for injecting aerated water into the body of water;

an intermediate pipe section with an input end coupled to the intake pipe and an output end coupled to the discharge pipe;

a pump for moving water from the perforate section of the intake pipe to the orifice of the discharge pipe; and a venturi assembly for injecting air into water flowing to and through and out of the discharge pipe into the body of water, the venturi assembly being located above the intake pipe and above the discharge pipe.

2. The system as set forth in claim 1 wherein the venturi assembly is within the intermediate pipe adjacent to the output end, the venturi assembly including a tubularly shaped, upwardly extending, air opening, and a primary nozzle upstream of the air opening to reduce the interior diameter of the intermediate pipe at the air opening and a secondary nozzle downstream of the air opening to increase the interior diameter of the intermediate pipe at the air opening whereby the body of water will be circulated when the pump is operating and the circulating water will be aerated through the operation of the venturi assembly.

3. The system as set forth in claim 1 wherein the discharge pipe is axially longer than the intake pipe.

4. The system as set forth in claim 1 wherein the discharge pipe is axially shorter than the intake pipe.

5. A venturi aeration circulation system for aerating and circulating water in a pond with a low interior venturi pressure in a safe, ecologically friendly, convenient and energy efficient manner, the system comprising, in combination:

an intake pipe positioned essentially horizontally beneath a waterline of a pond adjacent to the bottom of the pond, the intake pipe having an interior section and an exterior section with an exterior rectangle extending upwardly transverse to the intake pipe, the exterior rectangle including a circumferential first perforate section, the intake pipe having an intermediate section with an upwardly extending rectangle extending upwardly parallel with the intake pipe, the intermediate rectangle including a circumferential second perforate section, the perforate sections adapted to receive stagnating un-aerated water from a lower extent of the pond during operation and use;

a discharge pipe positioned essentially horizontally and about midway between a waterline of a pond and the intake pipe, the discharge pipe being positioned above and laterally offset from the intake pipe, legs supporting the discharge pipe, the discharge pipe having an interior section and an exterior section with an exterior orifice and an intermediate section with a plurality of upwardly facing axially spaced orifices for injecting aerated water into an upper extent of a pond during operation and use, the discharge pipe having an axial length greater than the intake pipe;

a housing in a rectilinear configuration positioned above ground adjacent to the pond, the housing having a top and a bottom, a front and a back, and first and second sides, an L-shaped pipe section within the housing, the L-shaped pipe having an input end adjacent to the first side and bottom of the housing and an output end adjacent to the second side and top of the housing;

a lower angled pipe coupling the output end of the intake pipe to the input end of the L-shaped pipe, the intersection of the intake pipe and the lower angled pipe being in a generally S-shaped configuration with the intake pipe having a greater diameter than the lower angled pipe, an upper angled pipe coupling the input end of the discharge pipe to the output end of the L-shaped pipe, the intersection of the discharge pipe and the upper angled pipe featuring the intake pipe extending into, and having a lesser diameter than, the lower angled pipe;

a pump in the housing operatively associated with the L-shaped pipe adjacent to the input end of the L-shaped pipe for moving water from the perforate sections of the intake pipe to the orifices of the discharge pipe; and a venturi assembly in the L-shaped pipe adjacent to the output end of the L-shaped pipe for injecting air into water flowing to and through and out of the discharge pipe into the pond, the venturi including a tubularly shaped, upwardly extending, air opening, a primary nozzle upstream of the air opening to reduce the interior diameter of the L-shaped pipe at the air opening and a secondary nozzle downstream of the air opening to increase the interior diameter of the L-shaped pipe at the air opening whereby pond water will be circulated when the pump is operating and the circulating water will be aerated through the operation of the venturi assembly.

* * * * *